US005916843A

United States Patent [19]

Weller

[11] Patent Number: 5,916,843

[45] Date of Patent: Jun. 29, 1999

[54] PICTURE WITH INTEGRATED PICTURE FRAME

[76] Inventor: John V.C. Weller, 1709 Bearhollow Rd., Greensboro, N.C. 27410

[21] Appl. No.: 08/934,600

[22] Filed: Sep. 22, 1997

[51] Int. Cl.[6] ..... B41M 5/035; B41M 5/38

[52] U.S. Cl. ..... 503/227; 264/239; 264/293; 428/14; 428/192; 428/194; 428/195; 428/913; 428/914

[58] Field of Search ..... 8/471; 264/239, 264/293; 428/192, 194, 195, 913, 914, 14; 503/227

[56] References Cited

U.S. PATENT DOCUMENTS 2,184,121 12/1939 Henriksen ..... 41/24

4,520,064 5/1985 Kanzelberger ..... 428/199

4,555,423 11/1985 Sands ..... 428/79

5,261,987 11/1993 Luening et al. ..... 156/235

*Primary Examiner*—Bruce H. Hess

*Attorney, Agent, or Firm*—Douglas L. Weller

[57] ABSTRACT

A produces a picture with an integrated picture frame. In the method, a dye sublimation process is used to transfer a design to a plastic sheet. The design includes an image of the picture and an image of the integrated picture frame for the picture. After transfer of the design to the plastic sheet, the plastic sheet is pressed in order to shape the plastic sheet into a three-dimensional form in appearance of a framed picture.

16 Claims, 12 Drawing Sheets

PICTURE WITH INTEGRATED PICTURE FRAME

BACKGROUND

The present invention concerns pictures and picture frames and pertains particularly to a picture which integrates the picture frame.

Generally a picture frame is used in order to make the best presentation of a picture. While the picture frame is essential for presentation of art, picture frames can be very expensive. This is especially the case, for example, where matting is used to best present the picture.

There have been attempts to provide inexpensive framing of artwork. For example U.S. Pat. No. 2,184,121 by Henry Henricksen, for ART WORK, sets out a method by which prints and etc., may be utilized, embellished, framed and treated to be available for decorative hanging and so on. His method is based on laminating paper with a resinous material in a press with several tons of pressure. The result is further laminated with other materials and resin and configurations to eventually form artwork with an integral frame. However, this is in itself a difficult and expensive process. Further the resulting texture of the picture is significantly different than a painted picture and the resulting texture of the picture is significantly different than wood or other materials typically used to construct a picture frame.

Likewise, U.S. Pat. No. 4,555,423 by Howard E. Sands, for MULTICOLORED UNITARY THERMOFORMED ARTICLE, sets out using a thermoforming mold having a insert-receiving portion into which is placed a preformed element. The process may be utilized to produce articles in which more than one preformed element is incorporated, and such multiple preformed elements may be of the same or distinct configurations of the same or distinct colorations. However, this process is complicated y the use of various components of plastics of differing colors and shapes to make up a single article. The components require resins to be bonded together.

SUMMARY OF THE INVENTION

In accordance with the preferred embodiment of the present invention, a method is presented for producing a picture with an integrated picture frame. In the method, a dye sublimation process is used to transfer a design to a plastic sheet. The design includes an image of the picture and an image of the integrated picture frame for the picture. After transfer of the design to the plastic sheet, the plastic sheet is pressed in order to shape the plastic sheet into a three-dimensional form in appearance of a framed picture.

In the preferred embodiment of the present invention, the design is originally printed on heat transfer paper using sublimation inks. The plastic sheet is pressed using a vacuum press. After the vacuum press is performed, excess plastic of the plastic sheet is trimmed in order to produce a finished product.

Additional features may be used in various embodiments to enhance the appearance of the finished products. For example, the design can additionally include an image of matting placed around the picture. Also, the three-dimensional form can include simulated brush strokes in a picture area. The three-dimensional form can also include simulated wood grain in a frame area.

The present invention allows for inexpensive production of a "framed" picture which is nevertheless of superior quality and appearance. The resulting product is hardy, durable, light weight, and may be readily handled and shipped.

DESCRIPTION OF THE PREFERRED EMBODIMENT

Figure 1:
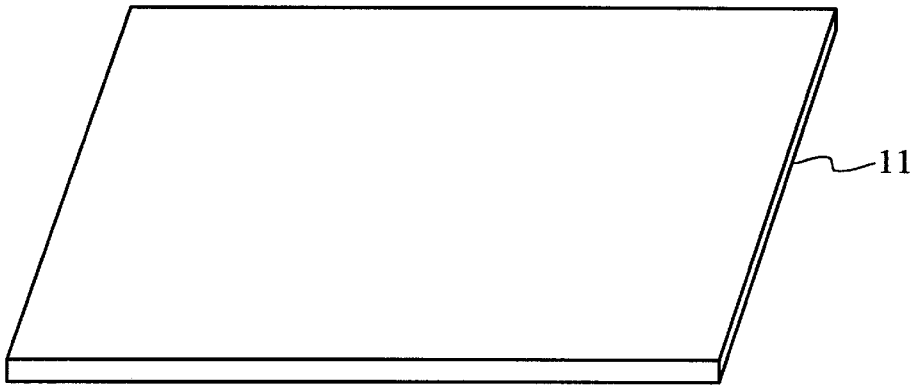
FIG. 1 shows a plain white plastic sheet to be used to form a picture with integrated picture frame in accordance with the preferred embodiment of the present invention.

FIG. 1 shows a plastic sheet 11. For example, plastic sheet 11 is plain, white and 30 to 40 mils thick. Such plain white (or clear) plastic sheets may be obtained for example from World-Pak Corporation, or from Nan Ya Plastics Corporation products distributed by Loeffler Sales, Inc.

Figure 2:
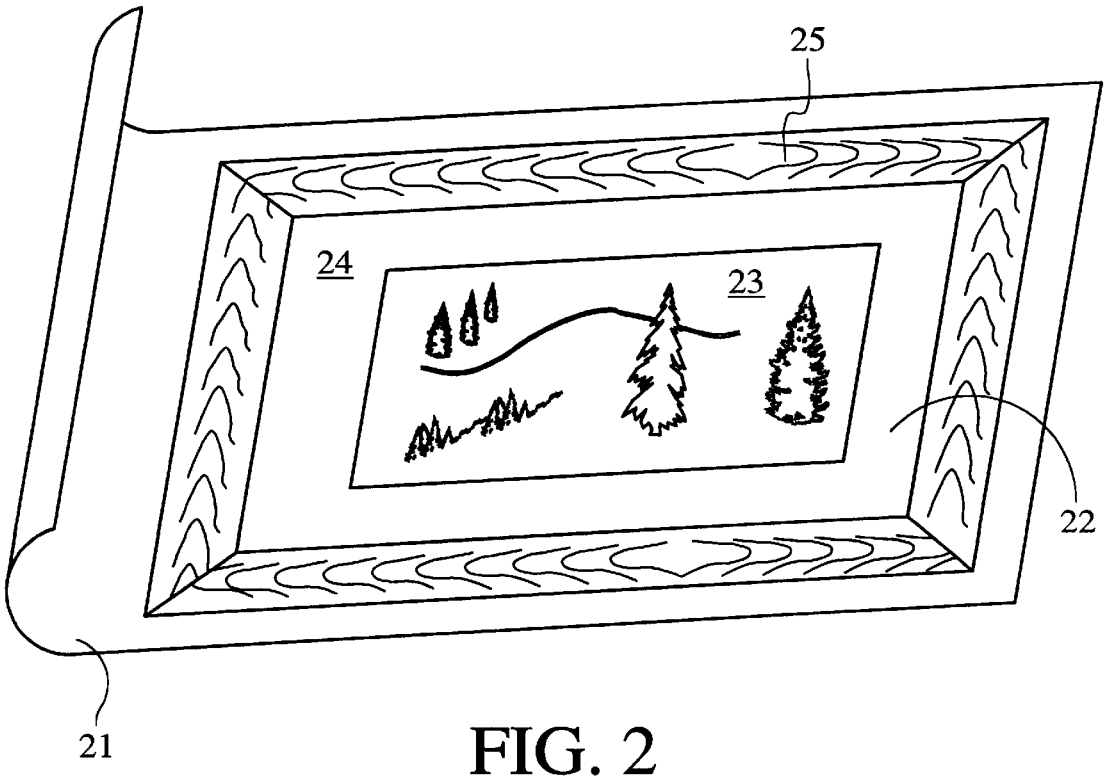
FIG. 2 shows heat transfer paper onto which has been printed a picture, matting and frame image using sublimation inks in accordance with the preferred embodiment of the present invention.

FIG. 2 shows heat transfer paper 21 on which has been printed a design 22 which includes a picture area 23, a matting area 24 and a frame area 25.

Figure 3:
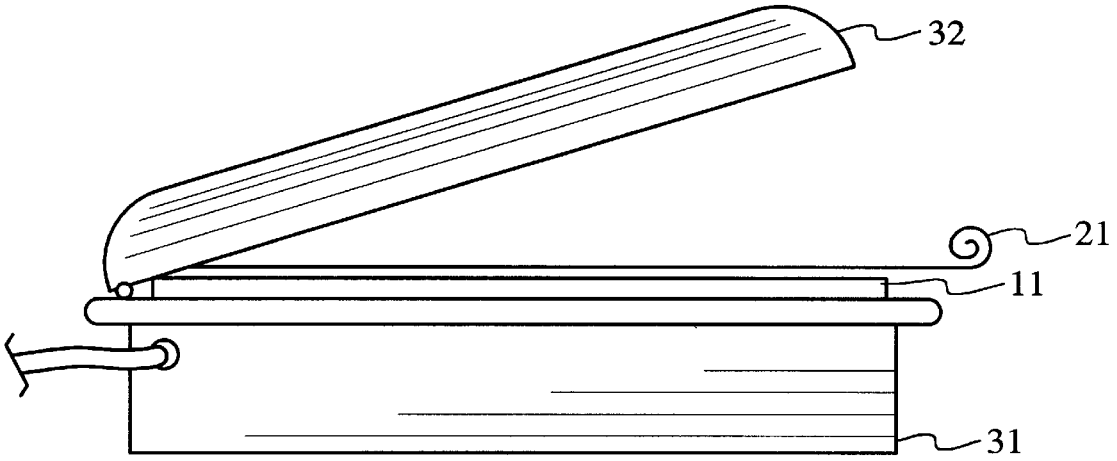
FIG. 3 and FIG. 4 show a heat transfer press being used to transfer the image on the transfer paper shown in FIG. 2 onto the plastic sheet shown in FIG. 1, in accordance with the preferred embodiment of the present invention.

FIG. 3 shows plastic sheet 11 and heat transfer paper 21 being placed within a heat transfer press 31. For example heat transfer press is a 30" by 36" Maxipress heat transfer press available from George Knight & Co., having a business address of 54 Lincoln Street, Brokton, Mass. 02403-0766. Heat transfer paper 21 is place so that design 22 (shown in FIG. 2) is in contact with plastic sheet 11.

Figure 4:
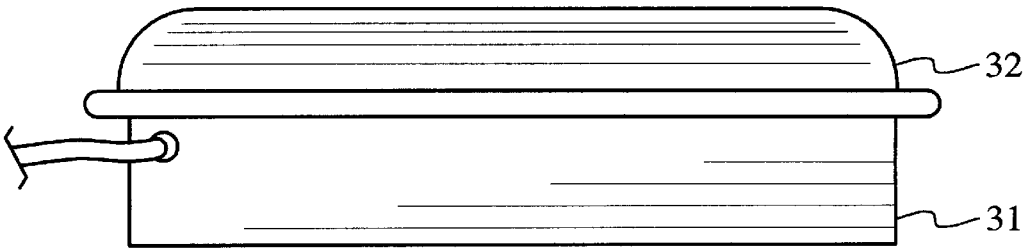

As illustrated by FIG. 4, a lid 32 of heat transfer press 31 is closed in order to operate the heat transfer press. Typically, heat transfer press 31 is operated at 400 degrees Fahrenheit for approximately 30 seconds in order to transfer design 22 to plastic sheet 11.

Figure 5:
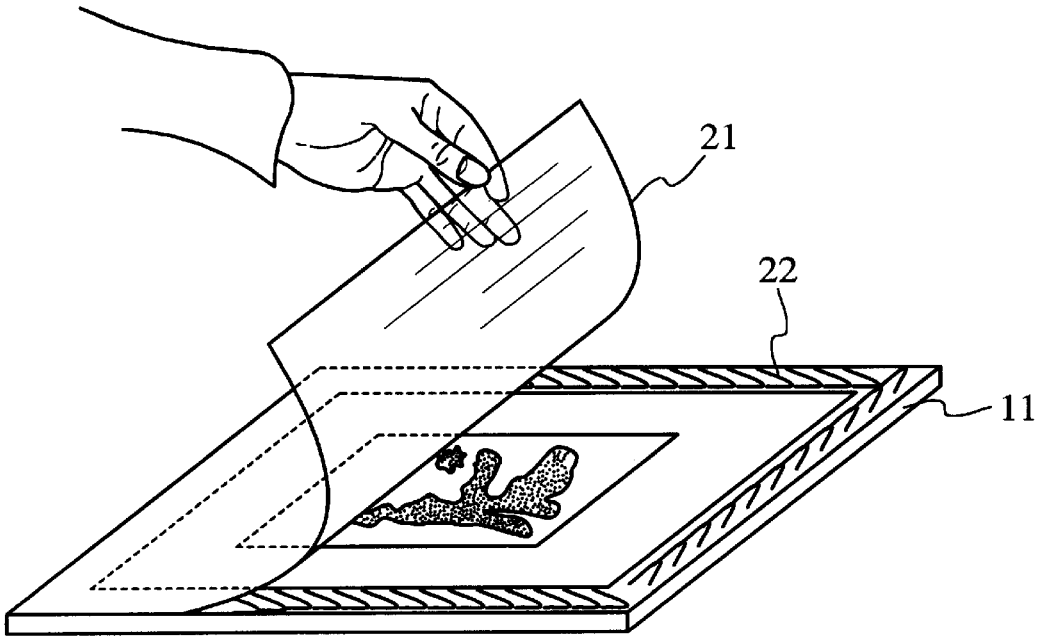
FIG. 5 illustrate the dye exhausted transfer paper being peeled back from the sublimated plastic sheet in accordance with the preferred embodiment of the present invention.

As illustrated by FIG. 5, after performing the heat transfer/sublimation process, heat transfer paper 21, now dye exhausted, is peeled back from plastic sheet 11. Design 22 has been transferred/sublimated to plastic sheet 11.

Figure 6:
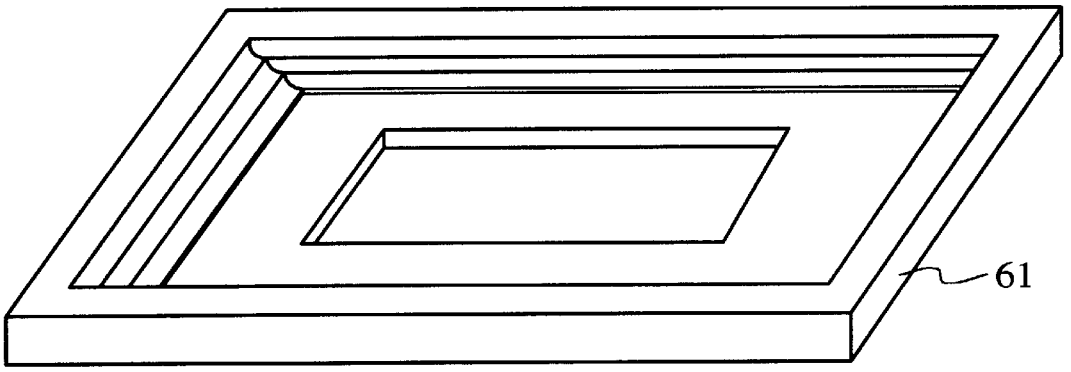
FIG. 6 shows a vacuum press form to be used to shape the picture with integrated picture frame in accordance with the preferred embodiment of the present invention.

FIG. 6 shows a vacuum press form 61 to be used to shape a picture with an integrated picture frame. For example, in one preferred embodiment, vacuum press includes texturing to simulate wood grains on the frame and brush strokes on the picture.

Figure 7:
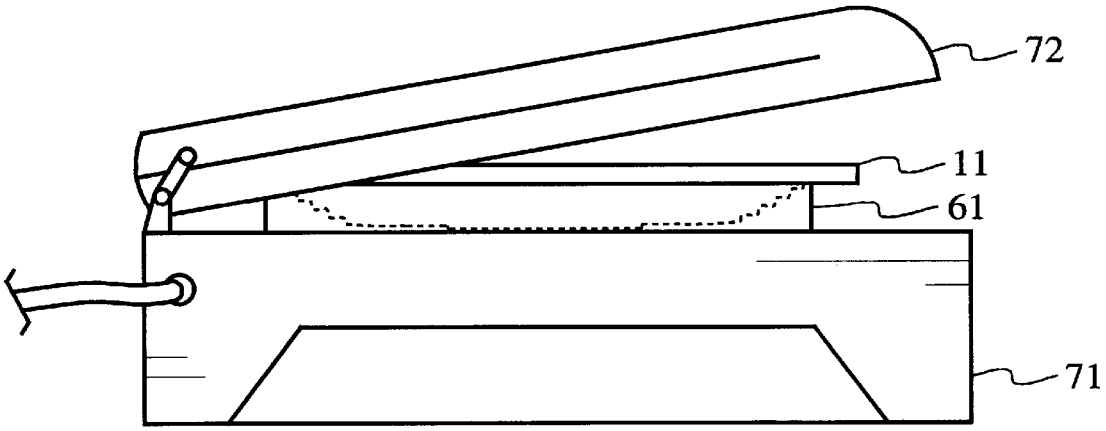
FIG. 7 shows a vacuum press being used to shape the sublimated plastic sheet shown in FIG. 5 into conformance with the form shown in FIG. 6, in accordance with the preferred embodiment of the present invention.

FIG. 7 shows vacuum press form 61 and sublimated plastic sheet 11 placed within a vacuum press 71. Lid 72 of vacuum press 71 is closed and vacuum press 71 heats sublimated plastic sheet at a temperature and for such a time as will allow plastic sheet 11 to become flexible and be pulled with a vacuum around vacuum press form 61, thus resulting in sublimated plastic sheet being formed in the shape of a picture with an integrated picture frame.

Figure 8:
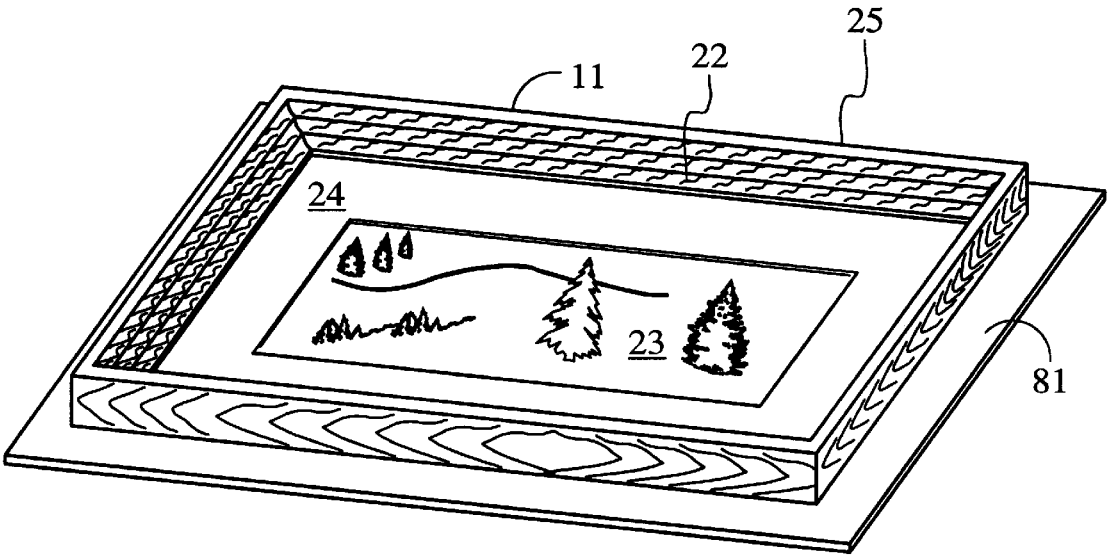
FIG. 8 shows the resulting plastic form in accordance with the preferred embodiment of the present invention.

FIG. 8 shows plastic sheet 11 having been formed in the shape of a picture with an integrated picture frame. Picture area 23 is relatively flat and may include brush strokes. Matting area 24 is slightly raised from picture area 23, simulating matting. Frame area 25 has the shape and texture of a frame. Additionally, plastic sheet 11 may include an excess plastic area 81 which can be trimmed in order to produce a finished product.

Figure 9:
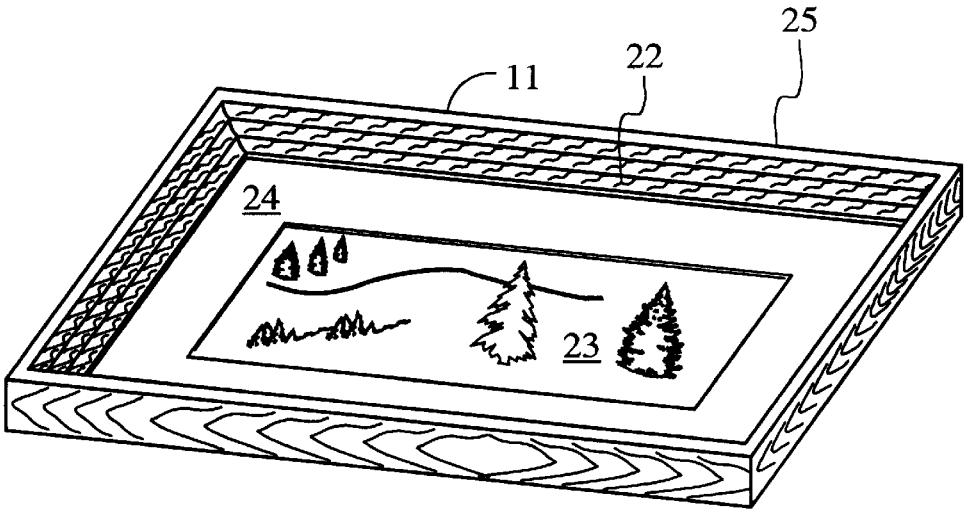
FIG. 9 shows the resulting plastic form of FIG. 8, trimmed in order to produce a finished product, in accordance with the preferred embodiment of the present invention.

FIG. 9 shows the finished product. Plastic sheet 11 has been trimmed. Picture area 23 is remains flat and may included brush strokes. Matting area 24 remains slightly raised from picture area 23, simulating matting. Frame area 25 retains the shape and texture of a frame.

The present invention may be utilized in various alternative embodiments.

Figure 10:
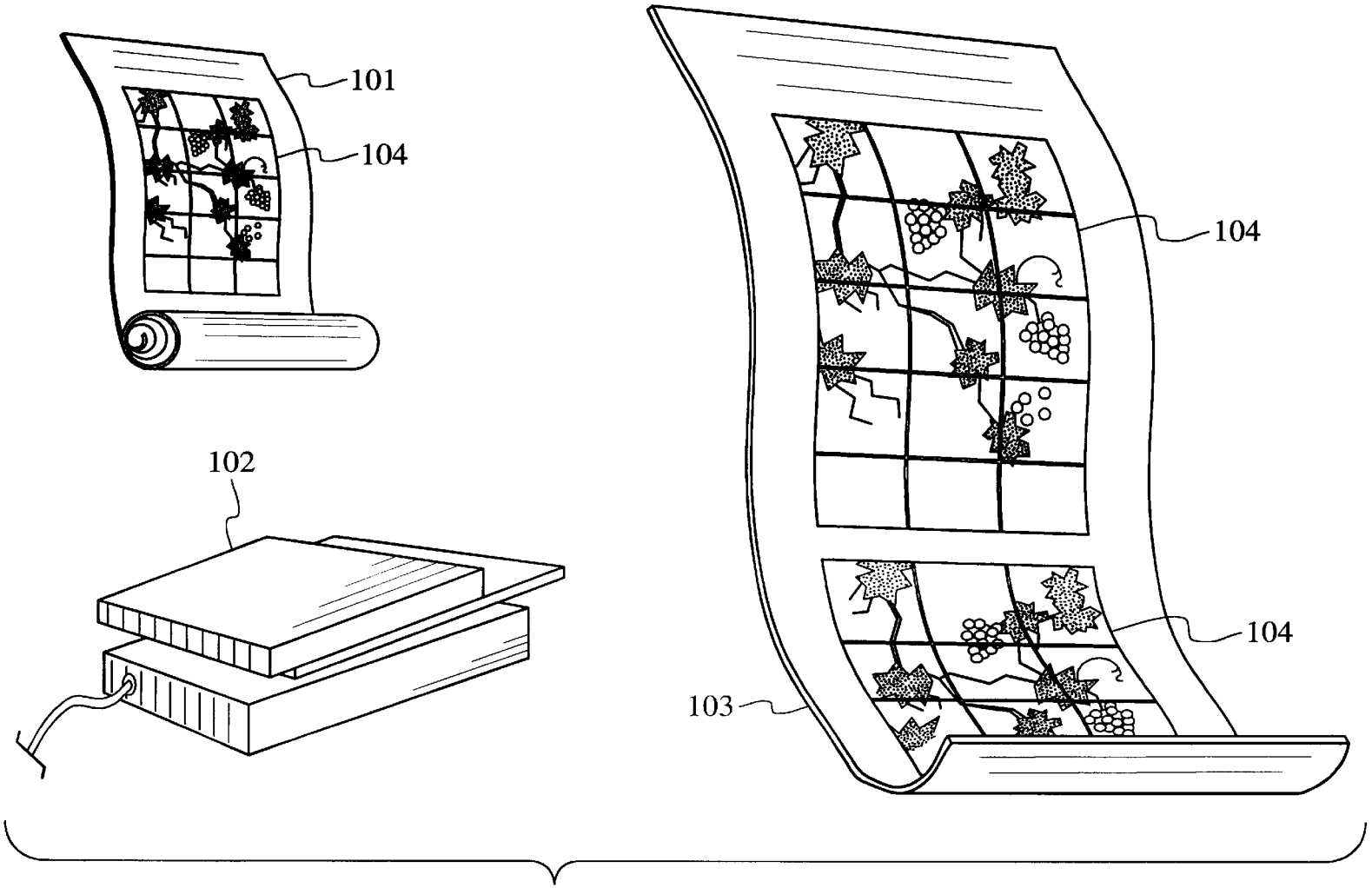
FIG. 10, FIG. 11 and FIG. 12 illustrate preparation of an integrated picture and frame where the finished product has the appearance of being on tile in accordance with a preferred embodiment of the present invention.

FIG. 10 shows heat transfer paper 101 on which has been printed a design 104. A heat transfer press 102 is used to place design 104 on a plastic sheet 103.

In one embodiment, before the design is sublimated onto plastic sheet 103 printed, plastic sheet 103 is first sprayed in a grout pattern using a grout concrete. The grout pattern is applied, for example, by using a spray gun and spraying the grout texture paint through a template which only permits the grout effect to adhere to plastic sheet 103 in predetermined area. Plastic sheet 103 is then ready to be printed with design pattern 104. Alternatively, the grout pattern may be incorporated directly within design pattern 104 without using the grout concrete.

As can be seen from FIG. 10, design pattern 104 includes a pattern simulating a series of tiles which appear to be set into a grout and will give the appearance of a "tiled mural".

Figure 11:
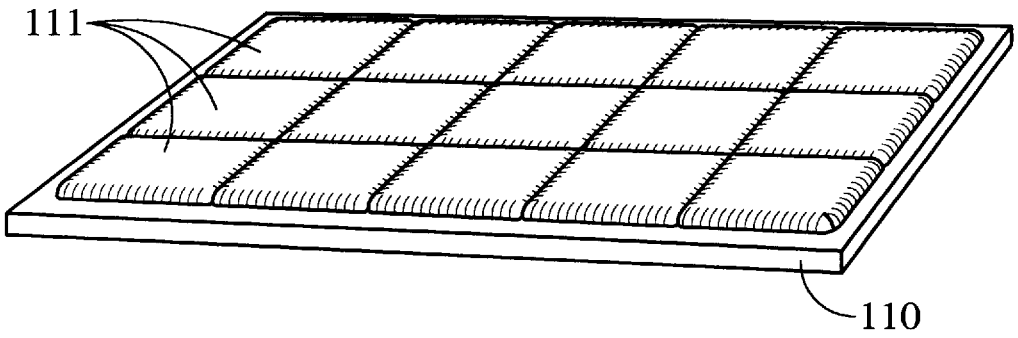

FIG. 11 shows a form 110 which includes "tile-like" protrusions 111 which echo the tiled effect of design pattern 104 on plastic sheet 103.

Figure 12:
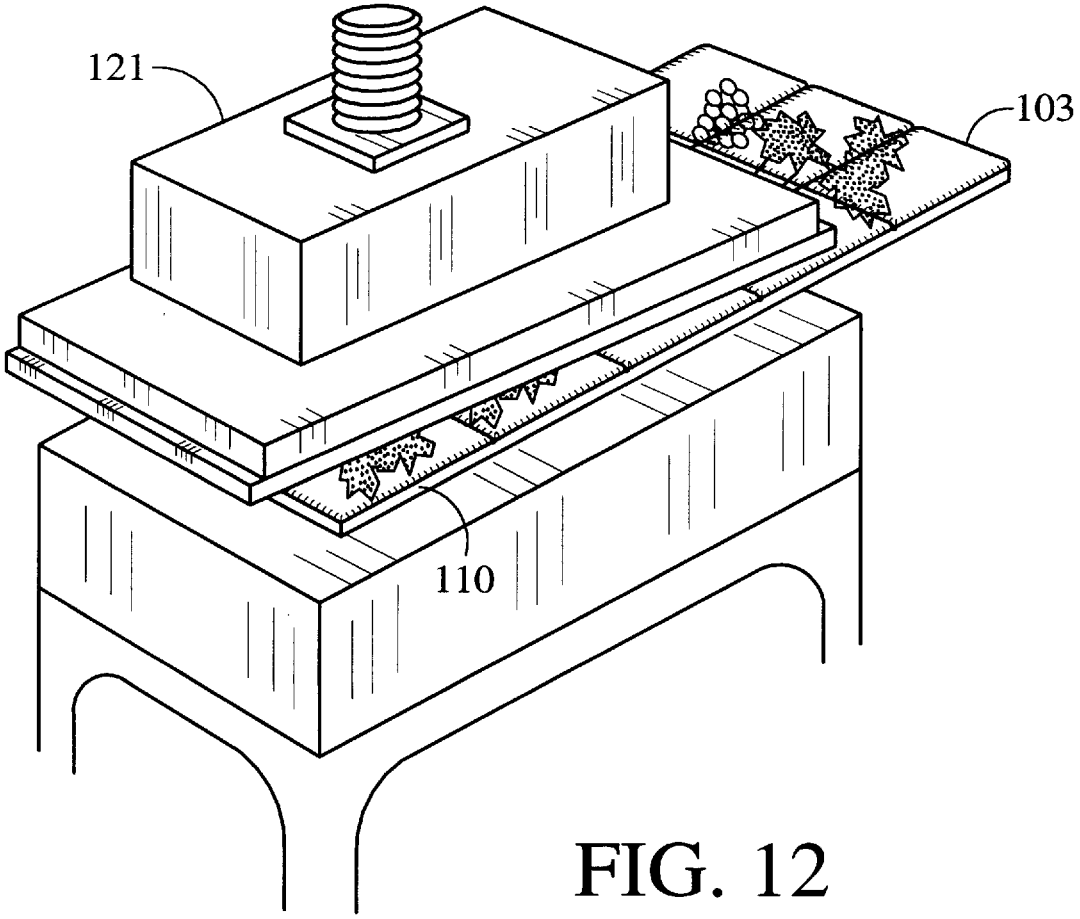

FIG. 12 shows a vacuum press 120 used to shape plastic sheet 103 into the shape of form 110.

Figure 13:
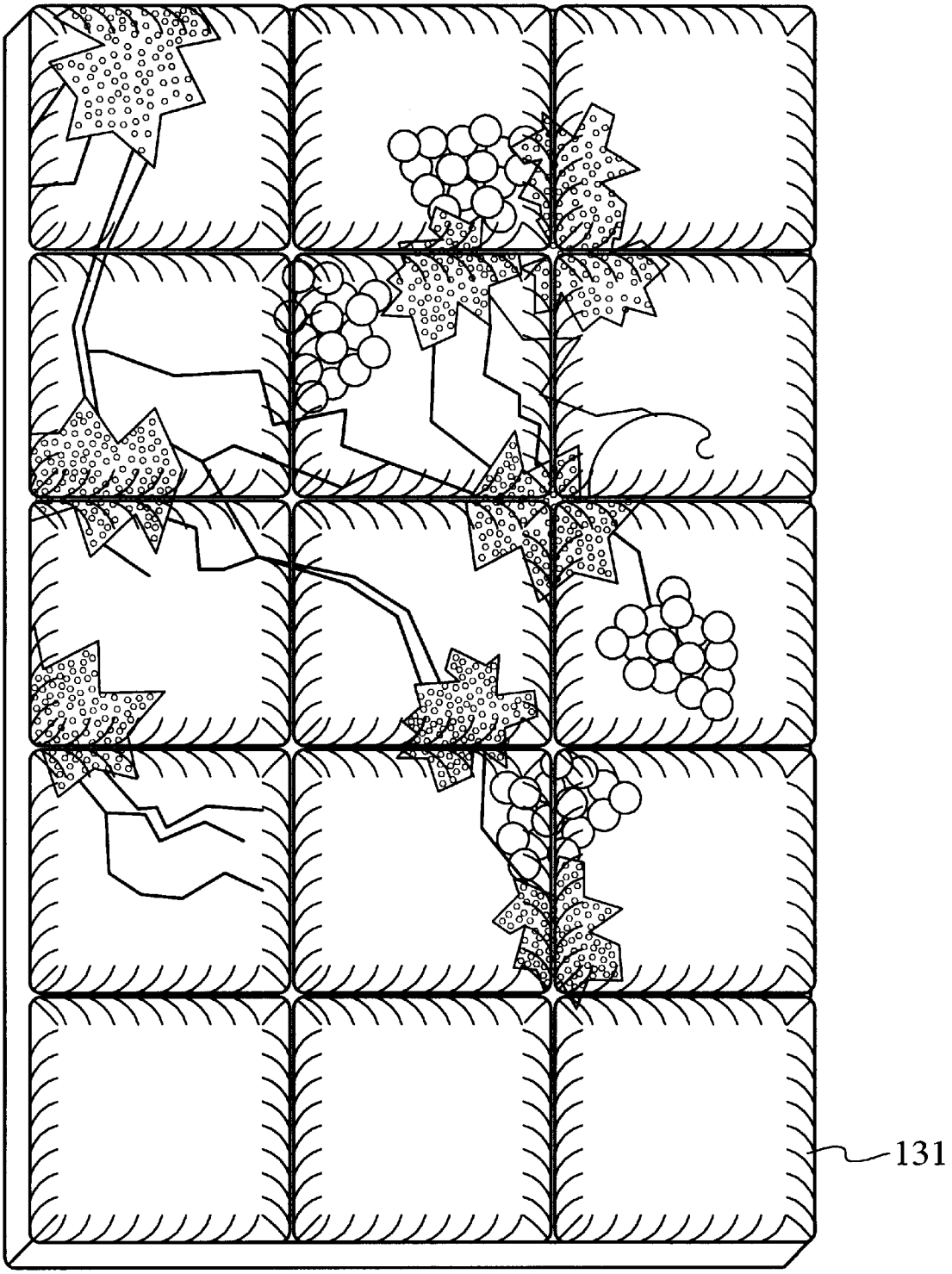
FIG. 13 shows an integrated picture and frame where the finished product has the appearance of being on tile in accordance with a preferred embodiment of the present invention.

FIG. 13 shows the finished product. Plastic sheet 103 has been removed from vacuum press 120 and any excess plastic trimmed. The result is a beautiful "tiled" mural 131. This tile mural can be used a wall hanging, a table top, a counter top, etc.

Figure 14:
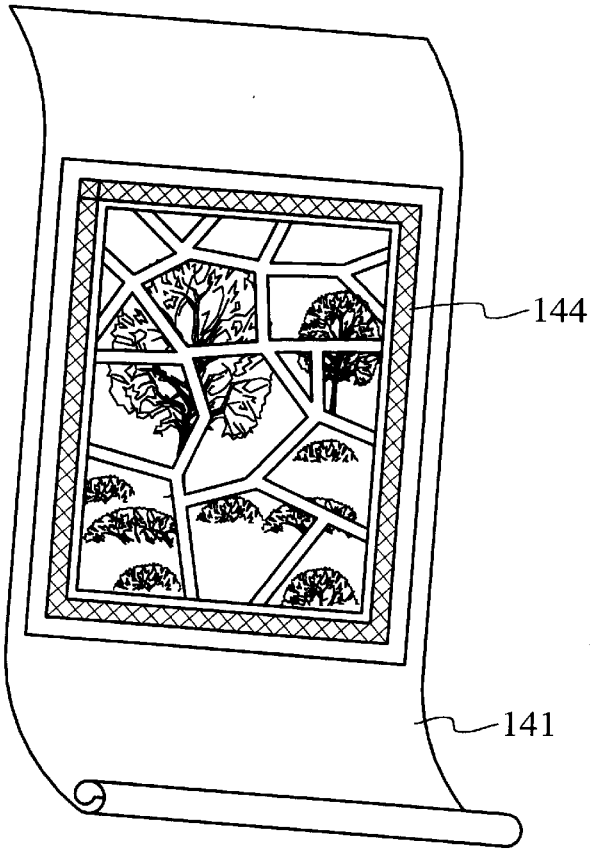
FIG. 14, FIG. 15, FIG. 16 and FIG. 17 illustrate preparation of an integrated picture and frame where the finished product has the appearance of stained glass in accordance with a preferred embodiment of the present invention.

FIG. 14 shows heat transfer paper 141 on which has been printed a design 144. Design 144 includes a beautiful stain glass appearance. A heat transfer press is used to place design 144 on a clear plastic sheet. After the transfer, design 144 will be "transparent" against the clear plastic. This will be enhanced with the introduction of light from natural or electric light sources.

The clear plastic may then be flipped over and opaque ink printed on the reverse side in appropriate background colors. For example, if a "wood" frame is included in the stained glass window, the background color opaque ink used to fill in the "wood" frame area would match the wood. Likewise, a lead-colored opaque ink is used to fill in the "leading" of the stained glass window. The use of this opaque ink will result in a finished plastic piece that truly has the image of stain glass, in which the "stain glass" area is transparent, and the "frame" area and "leading" area are not transparent.

Figure 15:
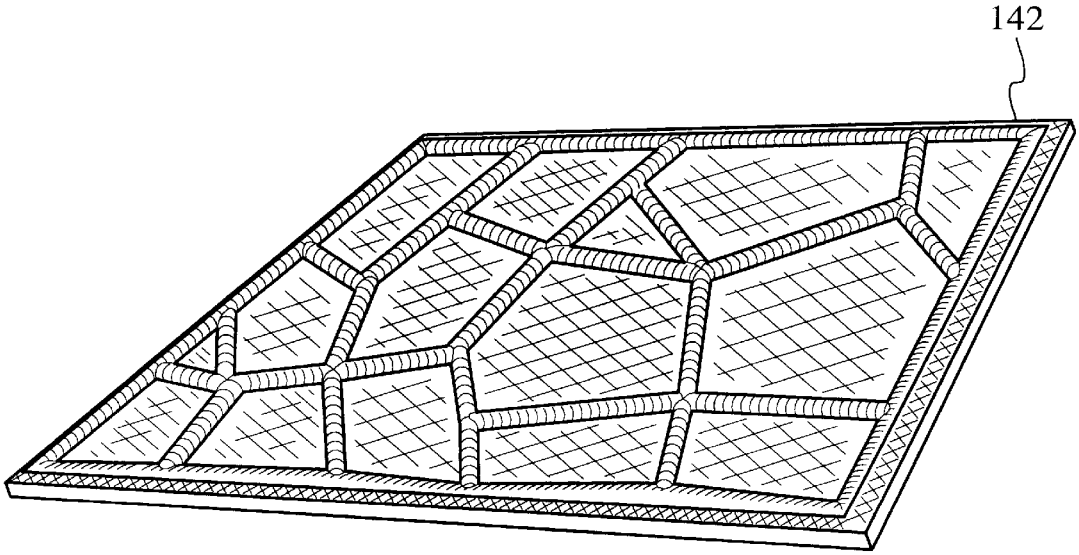

FIG. 15 shows a form 142 which includes protrusions which simulate a stained glass pattern.

Figure 16:
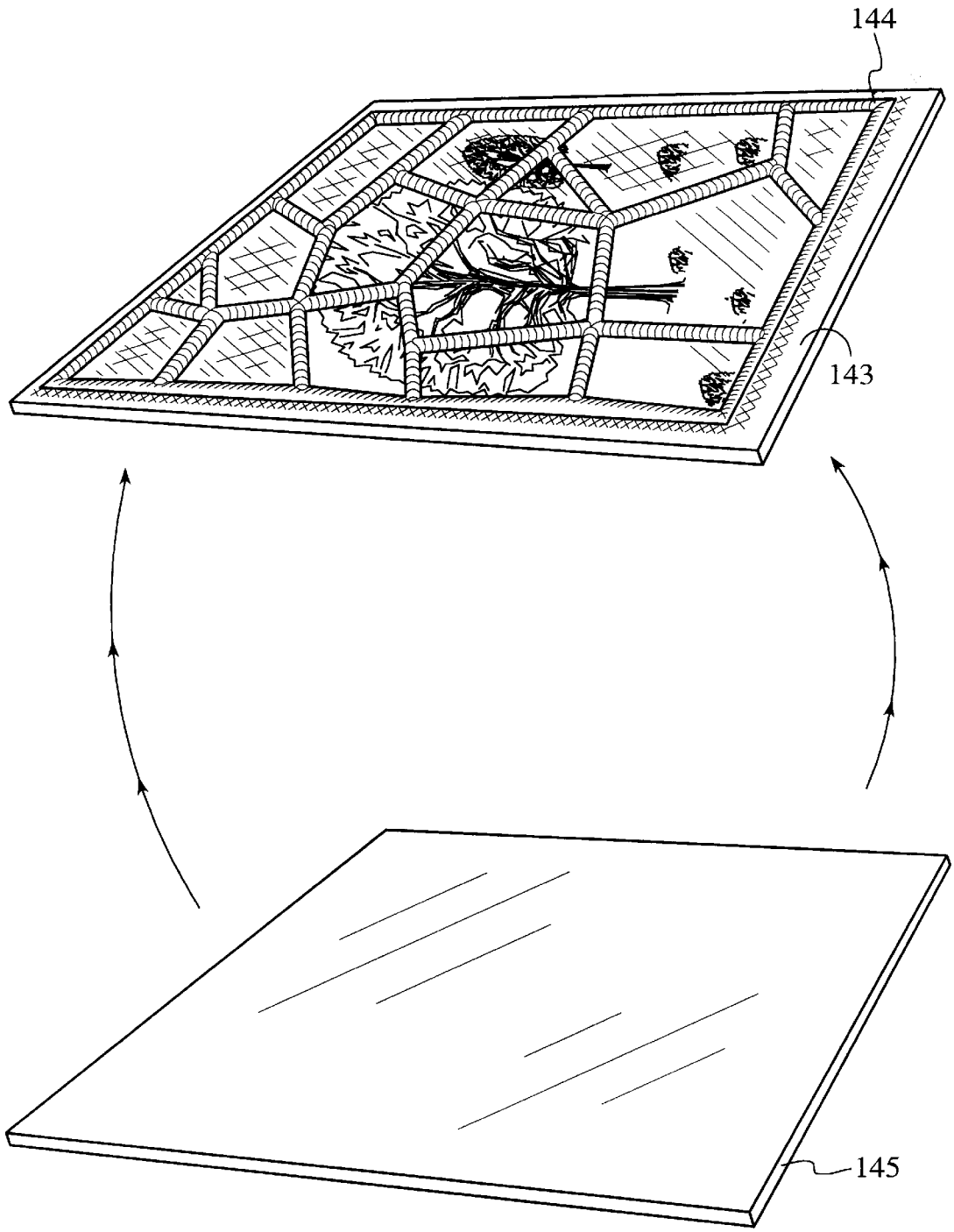

FIG. 16 shows a clear plastic sheet 143 having been sublimated with design 144 and after a vacuum press has been used to shape plastic 143 sheet into the shape of form 142.

The backing of plastic sheet 143 may be left open to allow for the introduction of light from natural or electric light sources. Alternatively a backing 145 may be place back under plastic sheet 143. For example, backing 145 is a plastic mirror or a metallic sheet. The metallic sheet, for example, may be brass, bronze, copper, stainless chrome or any desirable color to provide a pleasing tint to the transparent colors of design 144. Alternatively, backing 145 may also be a clear backing with a colored or metallic tint, as is desired.

Figure 17:
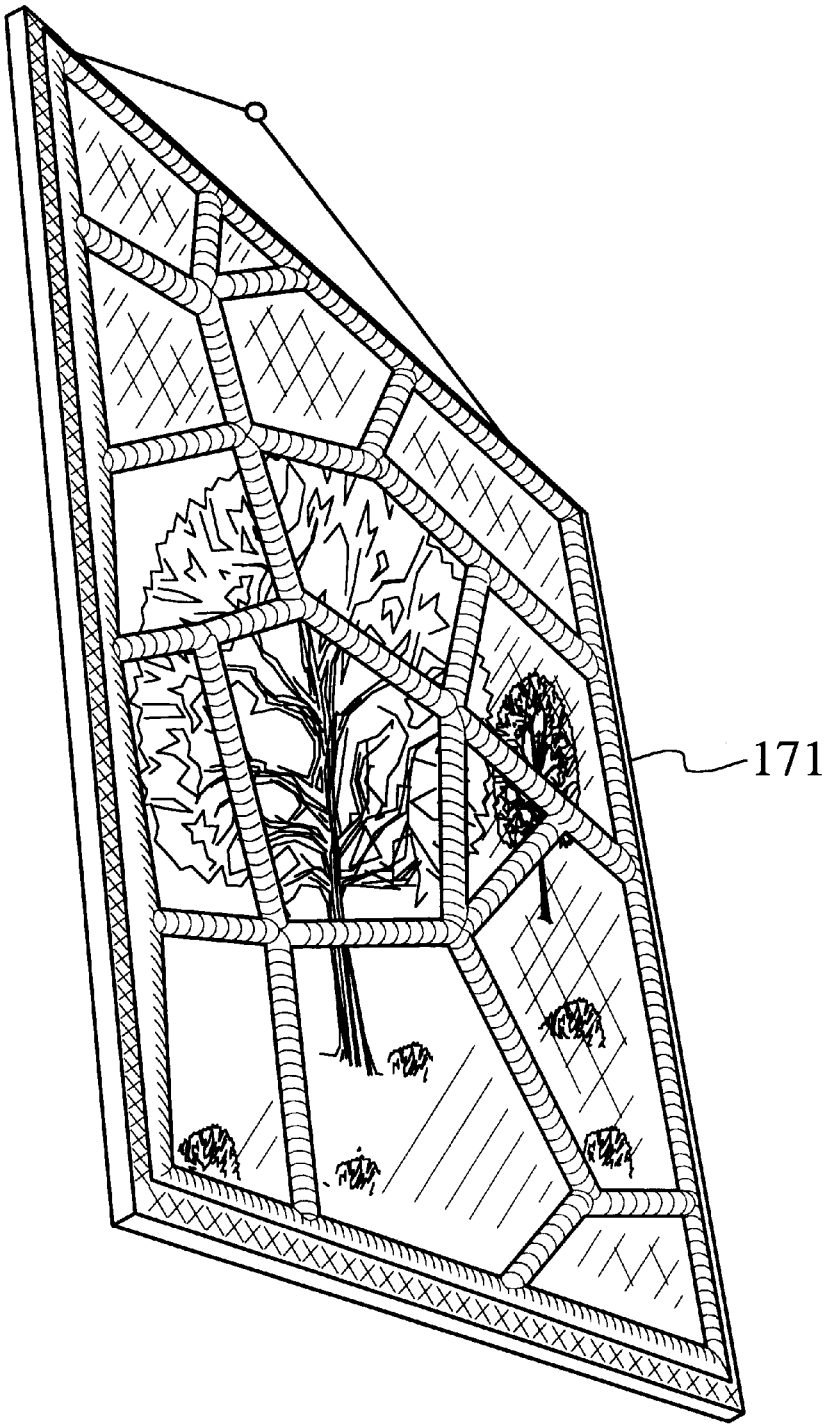

As shown in FIG. 17, any excess plastic is removed to produce a finished product 171.

The various embodiments of the present invention allow for a finished product which has a consistent size, shape and weight. In the past, without such uniformity in artwork, pictures are hung using wires attached to the frame by screws. This allowed for adjustments in the balance point of the picture. This is necessary because of the idiosyncrasies of each picture and frame combination. In the present invention, the use of wire may be replaced as shown in FIG. 18.

Figure 18:
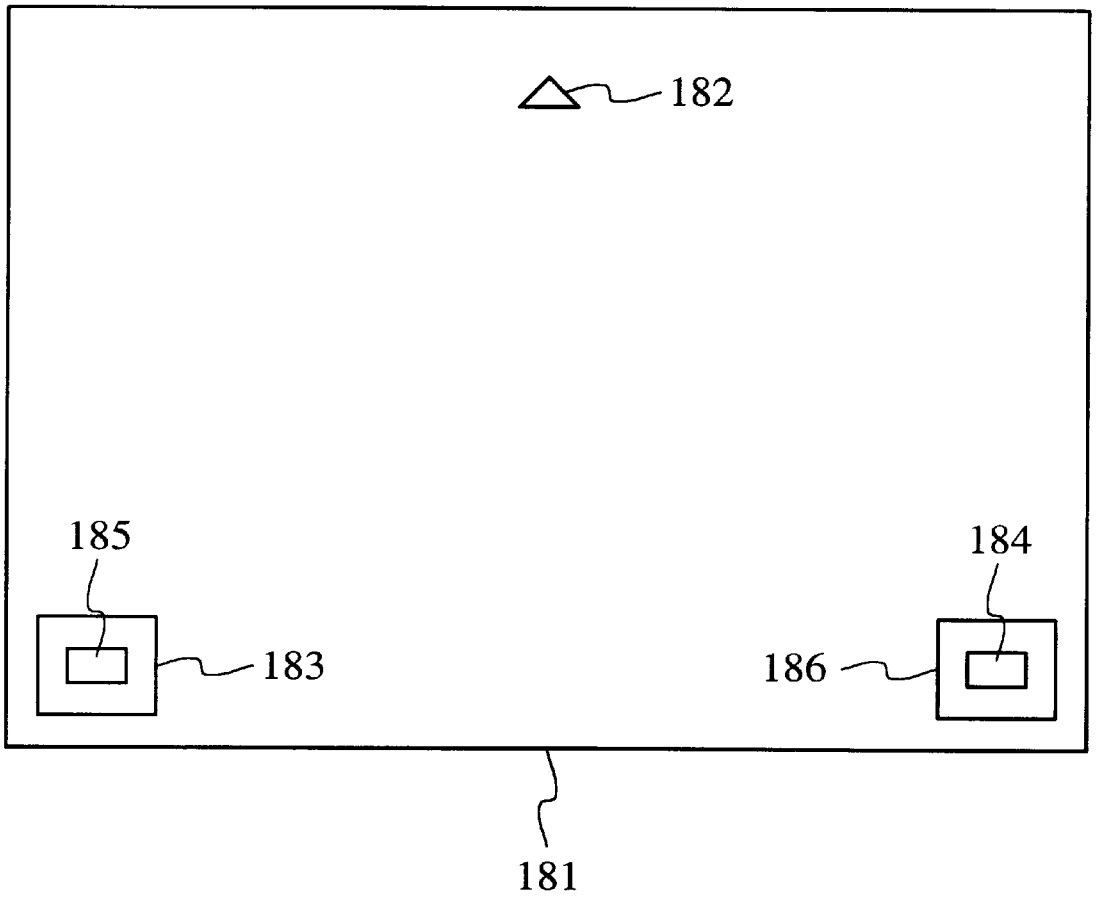
FIG. 18 shows weighting of a frame for effective hanging in accordance with a preferred embodiment of the present invention.

FIG. 18 shows the back of a picture produced in accordance with a preferred embodiment of the present invention. The plastic sheet includes a pre-punched triangular nail hole directly on the back of the frame in an exact position which enables a balanced hanging. To assure for perpendicular hanging, a weight 185 and a weight 186 are respectively placed within a receptacle 183 and a receptacle 184. This will result in the picture and frame finding an appropriate center of gravity which provides a perfect hanging. Felt may be placed over weight 185 and weight 186 to enhance the appearance, protect the wall, and to allow for "gripping" to the wall of the finished product.

The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

I claim:

1. A method for producing a picture with an integrated picture frame comprising the following steps:

(a) using a dye sublimation process to transfer a design to a plastic sheet, the design including an image of the picture and an image of the integrated picture frame for the picture;

(b) after transfer of the design to the plastic sheet in step (a), pressing the plastic sheet to shape the plastic sheet into a three-dimensional form in appearance of a framed picture.

2. A method as in claim 1 wherein in step (a) the design additionally includes an image of matting placed around the picture.

3. A method as in claim 2 wherein in step (b) the framed picture includes matting.

4. A method as in claim 1 wherein in step (b) the three-dimensional form includes simulated brush strokes in a picture area.

5. A method as in claim 1 wherein in step (b) the three-dimensional form includes simulated wood grain in a frame area.

6. A method as in claim 1 wherein step (b) is performed using a vacuum press.

7. A method as in claim 1 wherein in step (a) the design is originally printed on heat transfer paper using sublimation inks.

8. A method as in claim 1 additionally comprising the following step:

(c) trimming excess plastic of the plastic sheet in order to produce a finished product.

9. A method as in claim 1 wherein:

in step (a) the design appears as a stained glass window, and the plastic sheet is composed of clear plastic; and, in step (b) the three-dimensional form is shaped as a stained glass window.

10. A method as in claim 9 additionally comprising the following step performed after step (a):

(c) applying, to the plastic sheet, opaque ink to areas in the design that appear as framing or leading of a stained glass window.

11. A method as in claim 9 additionally comprising the following step:

(c) placing a backing on the plastic sheet.

12. A method as in claim 11, wherein the backing is one of the following:

metallic;

mirrored plastic; and, tinted plastic.

13. A method as in claim 1 additionally comprising the following step:

(c) including in a back of the plastic sheet a nail hole.

14. A method as in claim 13 additionally comprising the following step:

(d) including in a back of the plastic sheet, at bottom corners, receptacle areas to receive weights.

15. A decorative article comprising:

picture area, comprising an area of a plastic sheet on which has been transferred, using a dye sublimation process, an artistic design; and frame area, comprising an area of the plastic sheet on which has been transferred, using the dye sublimation process, a design representing framing for the artistic design;

wherein the plastic sheet has been pressed into a three-dimensional appearance of the frame area after using the dye sublimation process.

16. A decorative article as in claim 15 additionally comprising:

a backing plate attached to a back of the plastic sheet;

wherein the plastic sheet comprises clear plastic.

* * * * *